US006591632B1

(12) United States Patent
Mahoney

(10) Patent No.: US 6,591,632 B1
(45) Date of Patent: Jul. 15, 2003

(54) CRYOGENIC LIQUEFIER/CHILLER

(75) Inventor: Kevin William Mahoney, Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/298,569

(22) Filed: Nov. 19, 2002

(51) Int. Cl.[7] ..... F25J 3/00
(52) U.S. Cl. ..... 62/613; 62/96; 62/434
(58) Field of Search ..... 62/613, 619, 96, 62/434

(56) References Cited

U.S. PATENT DOCUMENTS

| | | | | |
|---|---|---|---|---|
| 3,677,019 A | | 7/1972 | Olszewski | 62/9 |
| 4,375,367 A | | 3/1983 | Prentice | 62/13 |
| 4,778,497 A | | 10/1988 | Hanson et al. | 62/11 |
| 5,836,173 A | * | 11/1998 | Lynch et al. | 62/613 |
| 6,041,620 A | | 3/2000 | Olszewski et al. | 62/612 |
| 6,041,621 A | * | 3/2000 | Olszewski et al. | 62/613 |
| 6,065,305 A | | 5/2000 | Arman et al. | 62/613 |
| 6,076,372 A | * | 6/2000 | Acharya et al. | 62/606 |
| 6,298,688 B1 | | 10/2001 | Brostow et al. | 62/613 |
| 6,357,257 B1 | | 3/2002 | Goble, Jr. et al. | 62/613 |
| 6,438,994 B1 | | 8/2002 | Rashad et al. | 62/613 |

* cited by examiner

*Primary Examiner*—Ronald C Capossela
(74) *Attorney, Agent, or Firm*—Stanley Ktorides

(57) ABSTRACT

A system for chilling and/or liquefying a fluid wherein a multicomponent refrigerant in a circuit is compressed, condensed, expanded and warmed to cool one or more portions of the fluid which are then turboexpanded to generate refrigeration and which are then used to provide refrigeration to a remaining portion of the fluid so as to chill and/or liquefy that remaining portion.

10 Claims, 2 Drawing Sheets

CRYOGENIC LIQUEFIER/CHILLER

TECHNICAL FIELD

This invention relates generally to providing refrigeration to a fluid and is particularly advantageous for use in conjunction with the operation of a cryogenic air separation plant for the production of liquefied industrial gas.

BACKGROUND ART

The production of liquefied industrial gas, such as liquid nitrogen, is very costly. Early liquefiers utilized single fluid mechanical refrigeration to provide forecooling at the higher temperatures with a turboexpander to provide refrigeration at lower temperature levels. The mechanical units provided the refrigeration at a fixed temperature. Later dual turbine liquefier cycles which eliminated the forecooler were introduced.

In view of the continuing demand for chilled or liquefied industrial gases, any improvement in systems for producing chilled or liquefied industrial gases would be highly desirable.

Accordingly, it is an object of this invention to provide an improved system for producing chilled or liquefied industrial gases.

SUMMARY OF THE INVENTION

The above and other objects, which will become apparent to those skilled in the art upon a reading of this disclosure, are attained by the present invention, one aspect of which is:

A method for providing refrigeration to a fluid comprising:

(A) compressing a multicomponent refrigerant, condensing the compressed multicomponent refrigerant, expanding the condensed multicomponent refrigerant, and warming the expanded multicomponent refrigerant by indirect heat exchange with said condensing compressed multicomponent refrigerant;

(B) compressing a fluid, cooling a first portion of the compressed fluid by indirect heat exchange with said warming expanded multicomponent refrigerant, and turboexpanding the cooled first portion of the fluid to generate refrigeration; and (C) warming the refrigeration bearing first portion of the fluid by indirect heat exchange with a second portion of the compressed fluid to provide refrigeration to the second portion of the fluid.

Another aspect of the invention is:

Apparatus for providing refrigeration to a fluid comprising:

(A) a multicomponent refrigerant circuit comprising a compressor, an expansion device, means including at least one cooling heat exchanger pass for passing compressed multicomponent refrigerant from the compressor to the expansion device, and means including at least one warming heat exchanger pass for passing multicomponent refrigerant fluid from the expansion device to the compressor;

(B) a turboexpander, a product heat exchanger, means for passing a first fluid portion in indirect heat exchange relation with said warming heat exchanger pass and thereafter to the turboexpander, and means for passing a second fluid portion to the product heat exchanger; and (C) means for passing the first fluid portion from the turboexpander to the product heat exchanger, and means for withdrawing refrigerated second fluid portion from the product heat exchanger.

As used herein the term "providing refrigeration" means chilling and/or liquefying.

As used herein the terms "turboexpansion" and "turboexpander" mean respectively method and apparatus for the flow of high pressure fluid through a turbine to reduce the pressure and the temperature of the fluid thereby generating refrigeration.

As used herein the term "expansion" means to effect a reduction in pressure.

As used herein the term "expansion device" means apparatus for effecting expansion of a fluid.

As used herein the term "compressor" means apparatus for effecting compression of a fluid.

As used herein the term "multicomponent refrigerant" means a fluid comprising two or more species and capable of generating refrigeration.

As used herein the term "refrigeration" means the capability to reject heat from a subambient temperature system.

As used herein the term "refrigerant" means fluid in a refrigeration process which undergoes changes in temperature, pressure and possibly phase to absorb heat at a lower temperature and reject it at a higher temperature.

As used herein the term "variable load refrigerant" means a mixture of two or more components in proportions such that the liquid phase of those components undergoes a continuous and increasing temperature change between the bubble point and the dew point of the mixture. The bubble point of the mixture is the temperature, at a given pressure, wherein the mixture is all in the liquid phase but addition of heat will initiate formation of a vapor phase in equilibrium with the liquid phase. The dew point of the mixture is the temperature, at a given pressure, wherein the mixture is all in the vapor phase but extraction of heat will initiate formation of a liquid phase in equilibrium with the vapor phase. Hence, the temperature region between the bubble point and the dew point of the mixture is the region wherein both liquid and vapor phases coexist in equilibrium. In the preferred practice of this invention the temperature differences between the bubble point and the dew point for a variable load refrigerant generally is at least 10° C., preferably at least 20° C., and most preferably at least 50° C.

As used herein the term "indirect heat exchange" means the bringing of two fluids into heat exchange relation without any physical contact or intermixing of the fluids with each other.

As used herein the term "subcooling" means cooling a liquid to be at a temperature lower than the saturation temperature of that liquid for the existing pressure.

DETAILED DESCRIPTION

Figure 1:
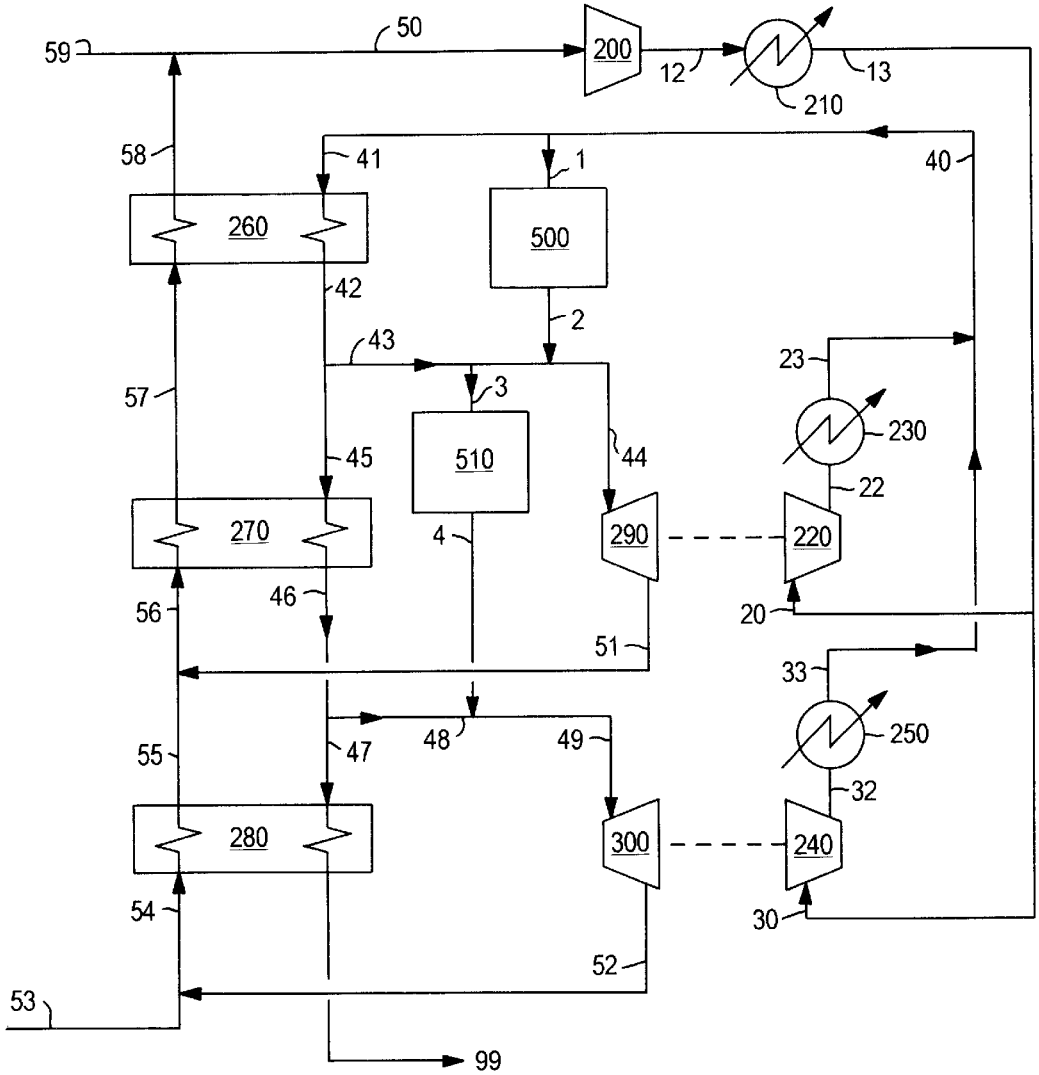
FIG. 1 is a schematic representation of one preferred embodiment of the cryogenic liquefier/chiller system of this invention.

The invention will be described in detail with reference to the Drawings. Referring now to FIG. 1, fluid 59 which is to be chilled and/or liquefied is combined with stream 58, which will be described more fully below, to form fluid stream 50. The fluid in stream 50 which is to be chilled and/or liquefied may be any suitable fluid such as gaseous nitrogen, oxygen, argon, hydrogen, carbon dioxide and methane, as well as mixtures containing one or more such gases such as air and natural gas. One particularly preferred fluid for processing in the practice of this invention is gaseous nitrogen taken from a cryogenic air separation plant.

Fluid stream 50 is passed to recycle compressor 200 wherein it is compressed to a pressure generally within the range of from 250 to 500 pounds per square inch absolute (psia). Resulting compressed fluid 12 is cooled of the heat of compression in cooler 210 and resulting compressed fluid 13 is divided into a first part 20 and a second part 30. First part 20 is further compressed in warm booster compressor 220 to a pressure generally within the range of from 400 to 800 psia. Boosted first part 22 is cooled of the heat of compression in cooler 230 to form boosted first part 23. Second part 30 is further compressed in cold booster compressor 240 to a pressure generally within the range of from 500 to 800 psia. Boosted second part 32 is cooled of the heat of compression in cooler 250 to form boosted second part 33 which is combined with boosted first part 23 to form compressed fluid 40.

Compressed fluid 40 is divided into a first portion 1 and a second portion 41. Generally first portion 1 will comprise from 5 to 20 percent of compressed fluid 40. First fluid portion 1 is cooled by indirect heat exchange with warming multicomponent refrigerant as will be more fully described below. In the embodiment of the invention illustrated in FIG. 1, this is shown in representational form by element 500. After the heat exchange with the warming multicomponent refrigerant fluid, the cooled first fluid portion 2 is turboexpanded to generate refrigeration.

Second portion 41 of compressed fluid 40 is passed to a product heat exchanger. In the embodiment of the invention illustrated in FIG. 1 the product heat exchanger comprises heat exchanger sections 260, 270 and 280 wherein heat exchanger section 260 is a warm heat exchanger section and heat exchanger section 280 is a cold heat exchanger section. Second portion 41 is cooled by passage through heat exchanger section 260 emerging therefrom as cooled second fluid portion 42. In the embodiment of the invention illustrated in FIG. 1 a third portion 43 of the compressed fluid is split off from second portion 42 and remaining second portion 45 is passed on for further cooling in heat exchanger section 270.

Third portion 43 is passed as stream 3 for cooling by indirect heat exchange with warming multicomponent refrigerant as will be more fully described below. In the embodiment of the invention illustration in FIG. 1, this heat exchange is shown in representational form by element 510 from which the cooled third fluid portion emerges as stream 4. Typically cooled first portion 2 has a temperature within the range of from 200 to 275° K, and cooled third portion 4 has a temperature which is less than that of cooled first portion 2 and generally within the range of from 150 to 200° K. If desired, some of stream 43 may not be used to form stream 3 but rather, as shown in FIG. 1, may be combined with cooled first fluid portion 2 for passage to warm turboexpander 290 as stream 44. Within warm turboexpander 290 the cooled first portion is turboexpanded to generate refrigeration emerging therefrom as refrigeration bearing first fluid portion 51. Preferably, as shown in FIG. 1, warm turboexpander 290 serves to drive warm booster compressor 220.

The further cooled second portion of the compressed fluid emerges from heat exchanger section 270 as stream 46 and is passed for still further cooling to heat exchanger section 280. In the embodiment of the invention illustrated in FIG. 1, a part of stream 46 is split off as stream 48 and combined with cooled third portion 4 to form stream 49 which is passed to cold turboexpander 300. Within cold turboexpander 300 the cooled third portion is turboexpanded to generate refrigeration, emerging therefrom as refrigeration bearing third fluid portion 52. Preferably, as shown in FIG. 1, cold turboexpander 300 serves to drive cold booster compressor 240.

Fluid stream 53 serves as the feed stream for the fluid to be processed by the practice of this invention. One particularly preferred source of stream 53 is a cryogenic air separation plant wherein stream 53 comprises gaseous nitrogen. Stream 53 is combined with refrigeration bearing stream 52 to form stream 54 which is warmed in heat exchanger section 280 by indirect heat exchange with cooling second fluid portion as will be further described below. Resulting stream 55 is withdrawn from heat exchanger section 280 and is combined with refrigeration bearing first fluid portion 51 to form stream 56 which is passed to heat exchanger section 270 of the product heat exchanger wherein it is warmed by indirect heat exchange with the aforesaid cooling second fluid portion. In the embodiment of the invention illustrated in FIG. 1, the turboexpanded first fluid portion 51 is passed to the product heat exchanger between the cold heat exchanger section 280 and the warm heat exchanger section 260. The resulting stream 57 is withdrawn from heat exchanger section 270, further warmed by indirect heat exchange in heat exchanger section 260 of the product heat exchanger by indirect heat exchange with the aforesaid cooling second fluid portion, and withdrawn therefrom as stream 58 which is combined with make up stream 59 to form aforedescribed fluid stream 50 for passage to recycle compressor 200.

Refrigeration is provided to the second portion of the fluid as it passes through the product heat exchanger by indirect heat exchange with the turboexpanded refrigeration bearing first portion, and in the embodiment of the invention illustrated in FIG. 1, the turboexpanded refrigeration bearing third portion of the fluid. The second fluid portion may be chilled, i.e. reduced in temperature though still in gaseous form, or may be both chilled and liquefied by passage through the product heat exchanger. Referring back now to FIG. 1, the cooled second fluid portion is passed as stream 47 to heat exchanger section 280 of the product heat exchanger wherein it is chilled and/or liquefied and/or subcooled by indirect heat exchange with aforesaid warming stream 54, emerging therefrom as refrigerated stream 99 for recovery as product. In the case where feed stream 53 is from a cryogenic air separation plant, some or all of product stream 99 could be returned to the cryogenic air separation plant, or some or all of product stream 99 could be passed to a use point or passed to storage for subsequent use.

Figure 2:
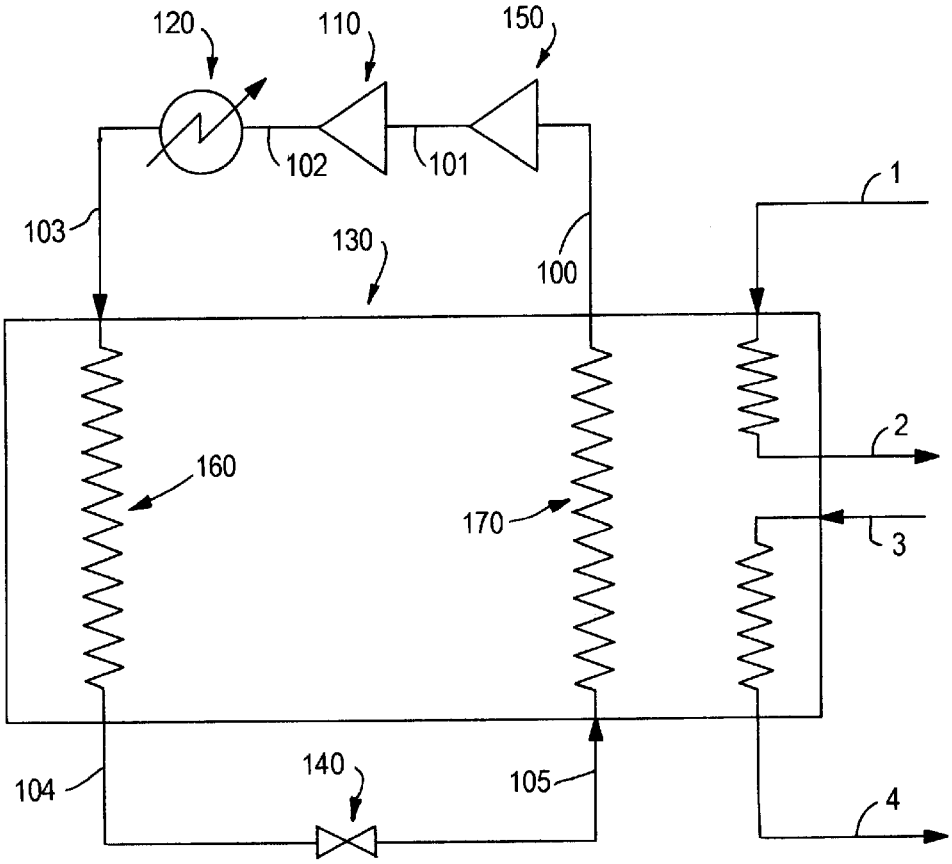
FIG. 2 is a representation of one preferred embodiment of the multicomponent refrigerant circuit which may be used in the practice of this invention.

FIG. 2 illustrates one embodiment of the multicomponent refrigerant circuit which serves to cool the first portion of the fluid, and in the embodiment of the invention illustrated in the Drawings, the third portion of the fluid, prior to the turboexpansion of these fluid portions. The numerals in FIG. 2 are the same as those of FIG. 1 for the common elements. In the embodiment illustrated in FIG. 2 there is one multicomponent refrigerant heat exchanger 130 rather than the two multicomponent refrigerant heat exchangers 500 and 510 shown with the embodiment illustrated in FIG. 1.

Referring now to FIG. 2, multicomponent refrigerant 100 is compressed by passage through compressor 150 to a pressure within the range of from 75 to 150 psia, and resulting multicomponent refrigerant 101 is further compressed by passage through compressor 110 to a pressure within the range of from 250 to 300 psia. Resulting compressed multicomponent refrigerant 102 is cooled of the heat of compression in cooler 120 and then passed in stream 103 to multicomponent refrigerant heat exchanger 130 which contains cooling pass 160 and warming pass 170. Typically the multicomponent refrigerant in stream 103 is partially condensed, i.e. the heavier or less volatile component or components of the multicomponent refrigerant are condensed by the cooling in cooler 120, and the compressed multicomponent refrigerant is completely condensed by passage through cooling pass 160 of heat exchanger 130 by indirect heat exchange with warming multicomponent refrigerant flowing in warming pass 170 of heat exchanger 130 as will be more fully described below.

The multicomponent refrigerant which maybe be used in the practice of this invention preferably comprises at least two species from the group consisting of fluorocarbons, hydrofluorocarbons, hydrochlorofluorocarbons, fluoroethers, atmospheric gases and hydrocarbons, e.g. the multicomponent refrigerant fluid could be comprised only of two fluorocarbons.

One preferred multicomponent refrigerant useful with this invention comprises at least one component from the group consisting of fluorocarbons, hydrofluorocarbons, and fluoroethers, and at least one component from the group consisting of fluorocarbons, hydrofluorocarbons, hydrochlorofluorocarbons, fluoroethers, atmospheric gases and hydrocarbons.

In one preferred embodiment of the invention the multicomponent refrigerant consists solely of fluorocarbons. In another preferred embodiment of the invention the multicomponent refrigerant consists solely of fluorocarbons and hydrofluorocarbons. In another preferred embodiment of the invention the multicomponent refrigerant consists solely of fluorocarbons, fluoroethers and atmospheric gases. Most preferably every component of the multicomponent refrigerant is either a fluorocarbon, hydrofluorocarbon, fluoroether or atmospheric gas. Furthermore, in a particularly preferred embodiment, the multicomponent refrigerant is a variable load refrigerant.

Referring back now to FIG. 2, condensed multicomponent refrigerant in stream 104 is expanded by passage through an expansion device such as Joule Thomson valve 140 and then passed as mostly liquid stream 105 to warming pass 170 of heat exchanger 130. As it passes through warming pass 170, the multicomponent refrigerant is warmed and vaporized by indirect heat exchange with the aforedescribed condensing multicomponent refrigerant in cooling pass 160, and also by indirect heat exchange with the aforedescribed cooling first portion 1 and third portion 3 of the compressed fluid, which emerge from heat exchanger 130 as cooled first and third portions 2 and 4 respectively. As will be understood by those skilled in the art, warming pass 170 of FIG. 2 is analogous to the unillustrated warming multicomponent refrigerant passing through elements 510 and 500 of FIG. 1. The warmed multicomponent refrigerant emerges from heat exchanger 130 as stream 100 for passage to compressor 150 and the multicomponent refrigerant circuit is completed.

An example of the invention was carried out using the multicomponent refrigerant circuit shown in FIG. 2 for the liquefaction of gaseous nitrogen taken from a cryogenic air separation plant, and the results are presented in Tables 1 and 2. In Table 1 the stream numbers are those of FIG. 2 and the concentrations of the various components are reported as mole fractions. The designation R14 stands for carbon tetrafluoride, the designation R218 stands for perfluoropropane, and the designation HFE-347 stands for perfluoropropoxymethane. In Table 2, which reports the unit power consumed, the results for the operation of the invention are shown in column B and, for comparative purposes, the results of a comparable liquefaction using a conventional liquefier system are shown in column A, with the difference shown in column C. In Table 2, the power consumed by the compressors of the multicomponent refrigerant circuit is reported as "MGR Comp Power". The example is presented for comparative purposes and is not intended to be limiting.

TABLE 1

| Stream | Flow Mcfh | Pres. psia | Temp. ° K. | Vapor Frac. | $N_2$ | Argon | R14 | R218 | HFE-347 |
|---|---|---|---|---|---|---|---|---|---|
| 1 | 400.0 | 652.3 | 298.1 | 1.000 | 1.0000 | 0.0000 | 0.0000 | 0.0000 | 0.0000 |
| 2 | 400.0 | 644.1 | 224.6 | 1.000 | 1.0000 | 0.0000 | 0.0000 | 0.0000 | 0.0000 |
| 3 | 700.0 | 647.0 | 224.6 | 1.000 | 1.0000 | 0.0000 | 0.0000 | 0.0000 | 0.0000 |
| 4 | 700.0 | 645.0 | 156.7 | 1.000 | 1.0000 | 0.0000 | 0.0000 | 0.0000 | 0.0000 |
| 100 | 549.2 | 40.0 | 295.2 | 1.000 | 0.0000 | 0.0316 | 0.2524 | 0.4837 | 0.2323 |
| 101 | 549.2 | 104.4 | 326.0 | 1.000 | 0.0000 | 0.0316 | 0.2524 | 0.4837 | 0.2323 |
| 102 | 549.2 | 271.5 | 360.0 | 1.000 | 0.0000 | 0.0316 | 0.2524 | 0.4837 | 0.2323 |
| 103 | 549.2 | 270.0 | 302.5 | 0.750 | 0.0000 | 0.0316 | 0.2524 | 0.4837 | 0.2323 |
| 104 | 549.2 | 268.0 | 153.9 | 0.000 | 0.0000 | 0.0316 | 0.2524 | 0.4837 | 0.2323 |
| 105 | 549.2 | 42.0 | 149.9 | 0.078 | 0.0000 | 0.0316 | 0.2524 | 0.4837 | 0.2323 |

TABLE 2

| | | A | B | C |
|---|---|---|---|---|
| Total Net $LN_2$ | mcfh | 452.5 | 552.6 | 100.1 |
| Recycle Power | kW | 6118 | 6111 | |
| Feed Gas Power | kW | 670 | 800 | |
| MGR Comp Power | kW | 0 | 1080 | |
| Total Liquefaction Power | kW | 6788 | 7991 | 1203 |
| Unit Power | kW/mcfh | 15.00 | 14.46 | 12.02 |

Although the invention has been described in detail with reference to certain preferred embodiments, those skilled in the art will recognize that there are other embodiments of the invention within the spirit and the scope of the claims.

What is claimed is:

1. A method for providing refrigeration to a fluid comprising:

(A) compressing a multicomponent refrigerant, condensing the compressed multicomponent refrigerant, expanding the condensed multicomponent refrigerant, and warming the expanded multicomponent refrigerant by indirect heat exchange with said condensing compressed multicomponent refrigerant;

(B) compressing a fluid, cooling a first portion of the compressed fluid by indirect heat exchange with said warming expanded multicomponent refrigerant, and turboexpanding the cooled first portion of the fluid to generate refrigeration; and (C) warming the refrigeration bearing first portion of the fluid by indirect heat exchange with a second portion of the compressed fluid to provide refrigeration to the second portion of the fluid.

2. The method of claim 1 wherein the fluid comprises nitrogen.

3. The method of claim 1 wherein the second portion of the fluid is liquefied by the provision of refrigeration to the second portion of the fluid.

4. The method of claim 1 further comprising cooling a third portion of the compressed fluid by indirect heat exchange with said warming expanded multicomponent refrigerant to a temperature less than that of the cooled first portion of the fluid, turboexpanding the cooled third portion of the fluid to generate refrigeration, and warming the refrigeration bearing third portion of the fluid by indirect heat exchange with the second portion of the fluid to provide refrigeration to the second portion of the fluid.

5. The method of claim 1 wherein the warming of the expanded multicomponent refrigerant serves to vaporize the expanded multicomponent refrigerant.

6. Apparatus for providing refrigeration to a fluid comprising:

(A) a multicomponent refrigerant circuit comprising a compressor, an expansion device, means including at least one cooling heat exchanger pass for passing compressed multicomponent refrigerant from the compressor to the expansion device, and means including at least one warming heat exchanger pass for passing multicomponent refrigerant fluid from the expansion device to the compressor;

(B) a turboexpander, a product heat exchanger, means for passing a first fluid portion in indirect heat exchange relation with said warming heat exchanger pass and thereafter to the turboexpander, and means for passing a second fluid portion to the product heat exchanger; and (C) means for passing the first fluid portion from the turboexpander to the product heat exchanger, and means for withdrawing refrigerated second fluid portion from the product heat exchanger.

7. The apparatus of claim 6 wherein said at least one warming heat exchanger pass is entirely within a single multicomponent refrigerant heat exchanger.

8. The apparatus of claim 6 wherein the product heat exchanger comprises a plurality of heat exchanger sections including a warm heat exchanger section and a cold heat exchanger section.

9. The apparatus of claim 8 wherein the first fluid portion is passed from the turboexpander to the product heat exchanger between the cold heat exchanger section and the warm heat exchanger section.

10. The apparatus of claim 9 further comprising a cold turboexpander, means for passing a third fluid portion in indirect heat exchange relation with said warming heat exchanger pass and thereafter to the cold turboexpander, and means for passing the third fluid portion from the cold turboexpander to the product heat exchanger.

* * * * *